United States Patent [19]

Stokes et al.

[11] Patent Number: 4,703,804

[45] Date of Patent: Nov. 3, 1987

[54] DEBRIS REMOVAL AND GAUGE RING DEVICE AND METHOD

[75] Inventors: Robert L. Stokes, Bullard; Paul Myrick, Tyler, both of Tex.

[73] Assignee: Gearhart Industries, Inc., Fort Worth, Tex.

[21] Appl. No.: 876,735

[22] Filed: Jun. 20, 1986

[51] Int. Cl.[4] ..... E21B 37/00; E21B 33/134

[52] U.S. Cl. ..... 166/311; 166/173; 166/387

[58] Field of Search ..... 166/387, 311, 99, 106, 166/107, 117, 169, 170, 118, 173, 179, 192

[56] References Cited

U.S. PATENT DOCUMENTS

| | | | |
|---|---|---|---|
| 367,824 | 8/1887 | Masseth | 166/387 |
| 2,228,242 | 1/1941 | Baker | 166/173 X |
| 2,665,766 | 1/1954 | Harlin | 166/173 |
| 2,687,774 | 8/1954 | Hodges | 166/173 X |
| 2,694,453 | 11/1954 | Longeval et al. | 166/173 X |
| 3,003,558 | 10/1961 | Orr | 166/311 X |
| 3,608,633 | 9/1971 | Talley, Jr. | 166/170 X |
| 3,730,268 | 5/1973 | Burnside | 166/311 X |

*Primary Examiner*—Stephen J. Novosad
*Assistant Examiner*—David J. Bagnell
*Attorney, Agent, or Firm*—Hubbard, Thurman, Turner & Tucker

[57] ABSTRACT

A device and method for removal of debris from well bores coincident with introduction and placement of a bridge plug. The device comprises a hollow cylindrical body open at both ends. The lower end of the device is adapted to form a gauge ring, integral with the body of the device for cleaning or scraping of the well casing. The body of the device is penetrated by a plurality of openings of sufficient size to allow the passage of fluid while confining debris within the body of the device. The upper end of the device is adapted to be frangibly connected to the bottom of the bridge plug to be placed in the well casing. The method includes preparation of a well for production, wherein debris removal and bridge plug placement may be safely and economically performed in a single operation.

3 Claims, 4 Drawing Figures

DEBRIS REMOVAL AND GAUGE RING DEVICE AND METHOD

FIELD OF THE INVENTION

This invention relates generally to devices and methods for removal of debris from the casings of oil, gas or water wells and, more particularily, removal of debris, gauging or scraping to assure an appropriate diameter, and placement of a bridge plug in conjunction with the completion of such wells for production activities.

BACKGROUND OF THE INVENTION

In connection with the completion of an oil, gas or water well in preparation for production from such well, it is frequently necessary and appropriate for the operator of the well to place a device known as a bridge plug in the casing of the well in order to segregate productive strata from non-productive strata within the depth pentrated by the well bore. The purpose and function of the bridge plug itself is well known and understood in the art.

In typical practice, in order to assure that no debris or other impediments to insertion of the bridge plug to the desired depth exist within the well casing, a debris removal device commonly known as a "junk basket" is inserted into the well casing and run to a depth below that selected for placement of the bridge plug. When the debris removal operation is completed, the junk basket is removed from the well casing, the bridge plug is inserted and fixed in the well casing at the desired depth.

However, in practice, the junk basket will occasionally encounter debris or other obstructions which cause it to lodge in the well casing above the depth selected for bridge plug placement. in that event, it is necessary to remove the obstruction by inserting a drill bit and drilling through both junk basket and obstruction. When such drilling operation is completed, the debris removal operation must be repeated, and upon its completion the final bridge plug placement operation is initiated.

Because bridge plugs in use in the industry are costly and relatively difficult to drill through should they become lodged in an unsuitable location in the well casing, the separate debris removal and gauging operation with a much less costly and essentially expendable junk basket has been standard practice. Although this standard practice does greatly reduce the risk of the bridge plug becoming lodged in an unsuitable location in the well casing, it suffers the distinct disadvantage of requiring two "runs" or "round trips" through the casing to place a single bridge plug. Such repetitive operations significantly lower the efficiency and increase the cost of bridge plug placement.

In recognition of that disadvantage, attempts have previously been made in the industry to combine the cleaning and gauging operation with the bridge plug placement operation, so that only a single run down the well casing is necessary. Such previous attempts have consisted primarily of merely fixedly attaching a junk basket device to the bottom of a bridge plug and concurrently introducing them into the well casing. The effectiveness of such attempts has been only marginal, however, in that they have achieved successful debris removal and bridge plug placement in a single operation only in those instances in which no obstruction to downward travel of the combined apparatus is encountered. When such obstructions are encountered, both junk basket and bridge plug become lodged in the casing in an unsuitable location for bridge plug placement. Upon such occurance the well completion operations cannot be continued until a drill bit is inserted into the casing to drill through both bridge plug and junk basket. Bridge plugs in common use in the industry are constructed of materials highly resistant to such drilling, making the drilling operation costly in terms of time as well as wasteful of an otherwise undamaged bridge plug. Thus, previous attempts to achieve concurrent debris removal and bridge plug placement reflect only an assumption of risk in return for the possibility of significant improvement in completion efficiency.

From the foregoing, it is apparent that a device and method to achieve the efficiency of concurrent debris removal and bridge plug placement while avoiding the high risks associated with previous attempts was needed and desired by the industry.

SUMMARY OF THE INVENTION

A debris removal and well casing gauging device comprising a tubular body generally cylindrical in shape, adapted at one end to be attached to the bottom of a standard bridge plug, and adapted at the opposite end to form what is known in the industry as a gauge ring. The gauge ring section of the device is somewhat larger in cross sectional diameter than the main body, and is intended to encounter and remove debris from the well bore throughout a sufficiently large cross sectional diameter to allow unobstructed passage of the remainder of the apparatus. The body of the device is hollow and open at the bottom, or gauge ring end. The tubular body of the device is penetrated by a plurality of openings of sufficient size to allow passage of fluids through the device as it is lowered into the well casing, while restricting passage of debris.

The upper end of the device, being the end opposite the gauge ring section, is adapted for attachment to a standard bridge plug by frangible attachment means. Such frangible attachment means are sufficiently rigid and strong to maintain firm connection between the device of this invention and the bridge plug as the combined apparatus is run down a well casing, but will disengage upon imposition of an upward force of lower magnitude than required disengage the bridge plug from the cable or other means of lowering the apparatus down the well casing.

The method of the present invention comprises connecting the upper end of the subject device to the lower end of a standard bridge plug to be placed in a well bore, utilizing the frangible connection means of the invention. A cable, or other suitable means of lowering and raising the apparatus, is connected to the top of the bridge plug, and the combined apparatus is introduced into the well casing and lowered by gravitational or forced travel through the casing to the desired bridge plug location.

Should downward travel of the combined apparatus through the well bore be arrested by an obstruction, the operator will commonly attempt to withdraw the combined apparatus from the well casing. In the event that the gauge ring section of the subject device has become lodged in the well bore as a result of encountering an obstruction, removal of the complete apparatus will be impossible. However, in the present invention, the force required to shear or break the connection between the subject device and the bridge plug is less than the force required to break the connection between the bridge plug and raising and lowering means for the apparatus, and the operator may safely apply upward force without risk of complete disconnection and loss of the bridge plug in the well casing. As upward force is applied by the operator, the bridge plug will be released from the subject device and may be removed from the well bore in an undamaged and reusable condition. The operator may then introduce a drill into the well casing and drill through the device as well as the obstruction, thereby clearing the casing and allowing reinsertion of the combined apparatus. it will be understood that in most instances the combined apparatus of bridge plug and the subject device of this invention will not become lodged in the well casing, and the bridge plug will be successfully positioned in a single operation, thus achieving the efficiency and lower cost of such single operation while concurrently avoiding the risk of loss and destruction of the costly bridge plug.

In order to facilitate the operation of drilling through the subject device should it become lodged in the well bore, the device of the present invention is preferably fabricated of high strength, low density material which will withstand the forces imposed in normal operation while offering relatively low resistance to drilling.

These and other features and advantages of the present invention may be more readily understood with reference to the accompanying drawings wherein:

DETAILED DESCRIPTION OF THE INVENTION

Figure 1:
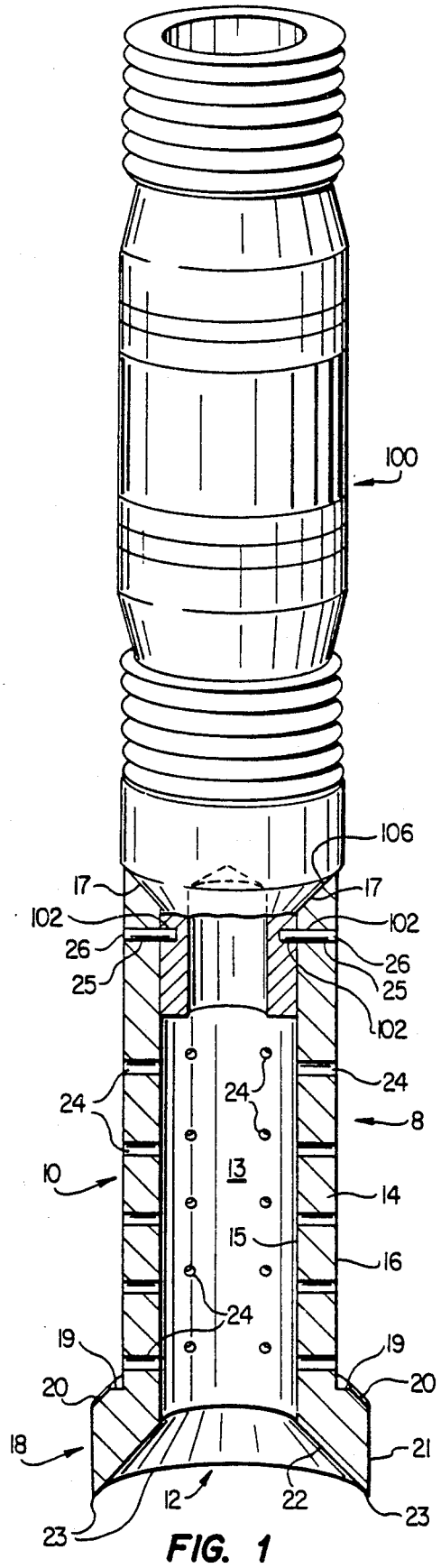
FIG. 1 is a pictorial illustration of the preferred embodiment of the debris removal and gauge ring device of the present invention, depicted in longitudinal section,interconnected to an accompanying bridge plug.
Figure 3:
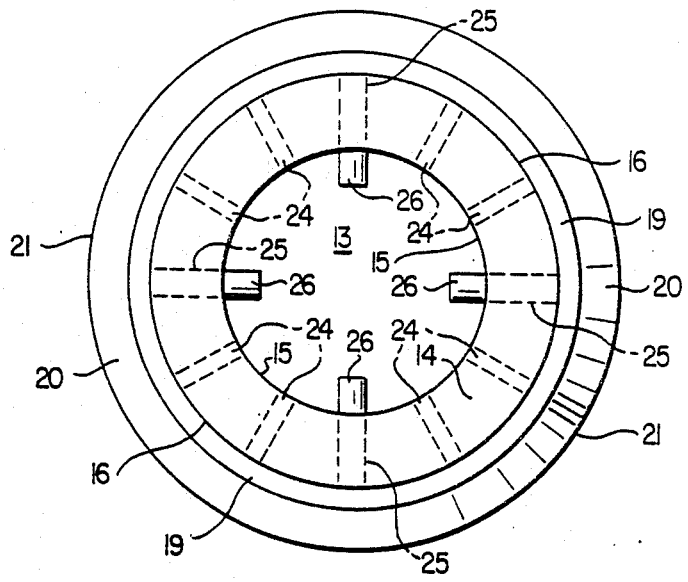
FIG. 3 is a plan view of the preferred embodiment of the debris removal and gauge ring device of the present invention.
Figure 2:
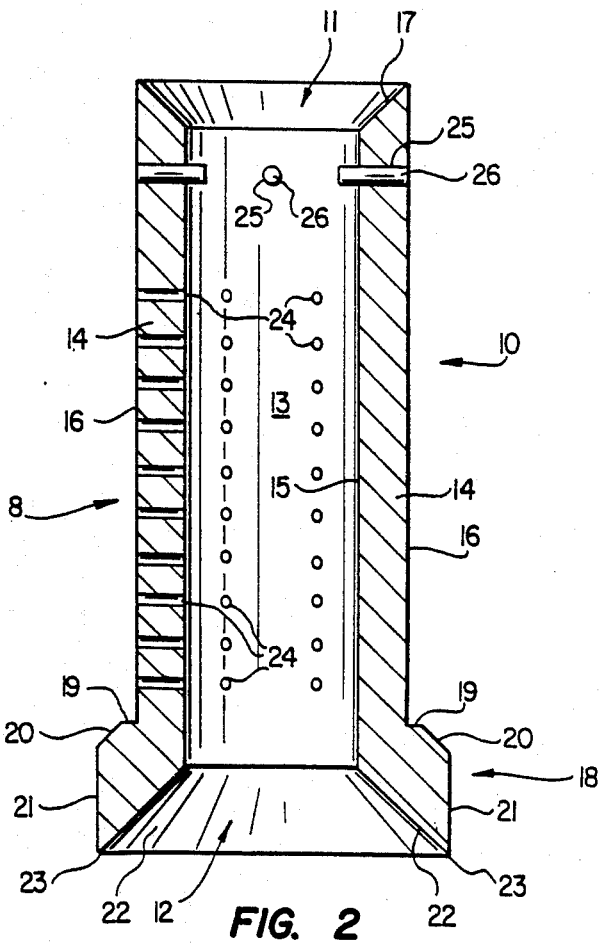
FIG. 2 is a longitudinally secitoned elevation view of the preferred embodiment of the debris removal and gauge ring device of the present invention.

With reference to the drawings, a detailed description of the preferred embodiment of the invention will be provided. Referring now to FIGS. 1,2 and 3, the device 8 of the invention will be seen to comprise, generally, a hollow cylindrical body 10, having a first open end 11 and a second open end 12, both giving access directly to the interior 13 of the body. The body 10 includes an annular wall 14, which defines inner surface 15 and outer surface 16, mutually concentric about the longitudinal axis of the device, as depicted in FIG. 2.

Still referring to FIGS. 1,2 and 3, a first or upper end of wall 14 is adapted to form a slanted terminal surface 17 defined by the intersection with inner surface 15 and outer surface 16 of an inverted conical surface section concentric about the longitudinal axis of the device. The second or lower end of wall 14 is adapted to form or gauge ring portion 18, integral with the body of the device.

The gauge ring portion comprises horizontal annular step 19, extending outward from and perpendicular to the outer wall surface 16, preferably a transition surface 20, a vertical outer surface 21, and an inner surface 22. Horizontal annular step 19 extends continuously around the full circumferance of the cylindrical body 10 and defines a circular outer edge concentric to the longitudinal axis of the device. In the preferred emboidment depicted, transition surface 20 consists of a conical surface section defined by its intersection with horizontal annular step 19 and vertical surface 21. Vertical surface 21 extends continuosly around the full circumferance of the device concentric to the longitudinal axis of the device. The inner surface 22 of the gauge ring portion of the device consists of a conical surface section defined by its intersection with vertical surface 21 and inner surface 15 of the annular wall 14, concentric to the longitudinal axis of the device. The intersection of vertical surface 21 and inner surface 22 of the gauge ring portion defines edge 23.

As depicted in the Figures, the hollow cylindrical body 10 includes a plurality of openings 24 fully penetrating annular wall 14 so as to allow the passage of fluids therethrough. Said openings 24 are of sufficient cross-sectional area and are sufficient in number to allow generally unrestricted passage of fluids while restricting passage therethrough of debris introduced into interior 13 through second open end 12.

The device of the present invention further comprises frangible interconnecting means disposed near but below terminal surface 17, so as to allow frangible interconnection between the subject device 8 and bridge plug 100 with which it is to be used. In the preferred embodiment depicted, said frangible interconnecting means comprises a plurality of apertures 25 penetrating wall 14 and coaxially aligned with an equal number of apertures 102 in bridge plug 100, for receiving shear pins 26. Shear pins 26 extend through apertures 25 and 102, disposed so that the outer end of pins 26 is substantially flush with outer surface 16. Shear pins 26 may be constructed of brass or of other frangible material suitable to the method of use hereinafter described.

The method of the present invention will now be described in detail with reference to the accompanying Figures. It will be recalled that the main purpose of the invention is to facilitate the completion of an oil, gas or water well by providing a device and method of effectively combining the operations of debris and method of effectively combining the operations of debris removal and bridge plug placement while avoiding the risk of bridge plug loss or destruction previously associated with attempts to combine such operations.

Figure 4:
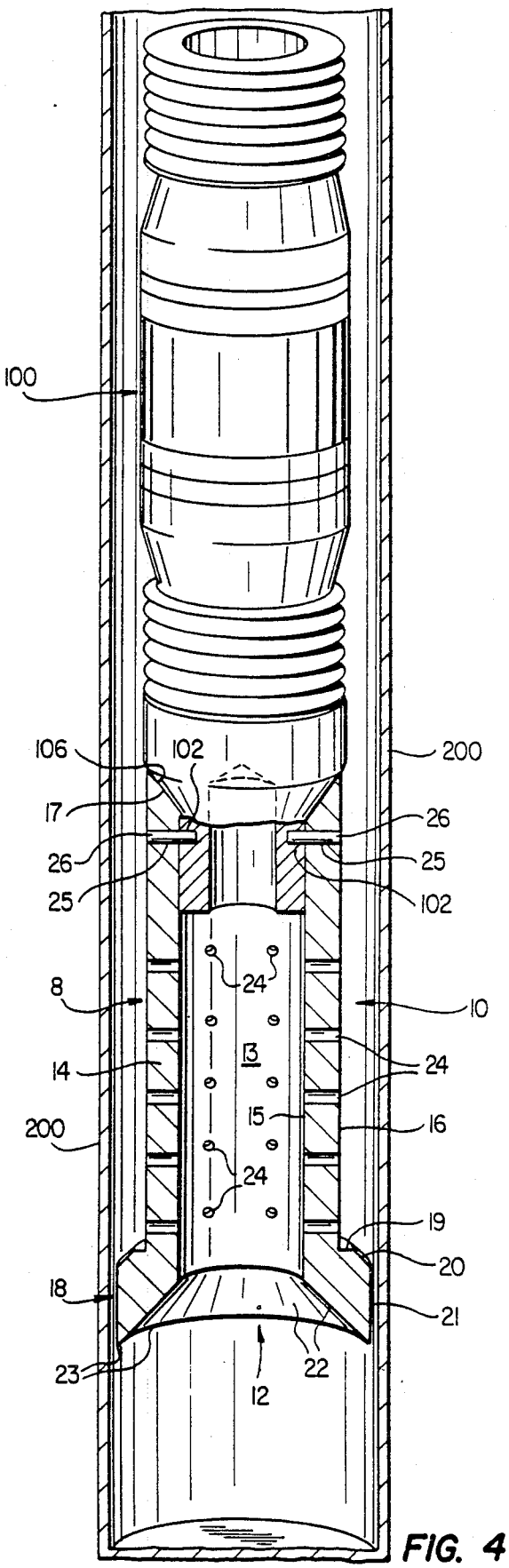
FIG. 4 shows the preferred embodiment of the debris removal and gauge ring device of the present invention, depicted in logitudinal section, connected to a bridge plug and disposed in a well casing, illustrating the method of the present invention.

Referring to FIGS. 1 and 4, the device 8 of the present invention, having suitable dimensional relationship to the standard bridge plug 100 to be placed in the well casing, and further having suitable dimensional relationship to the standard well casing employed, is selected. The subject device 8 is brought into mating relationship with bridge plug 100 by inserting bridge plug nipple 104 into interior 13 through first open end 11 until terminal surface 17 abuts bridge plug mating surface 106. The debris removal device is then frangibly interconnected to bridge plug 100 by, preferably, bringing apertures 25 in the body 10 into coaxial alignment with corresponding apertures 102 and inserting shear pins 26 therethrough. Raising and lowering means (not shown) is then releaseably connected to bridge plug 100 at the end opposite bridge plug nipple 104, such that interconnected bridge plug 100 and debris removal device 8 are pendantly disposed from said raising and lowering means. Any convenient conventional raising and lowering means utilized for well completion operations may be employed, and any convenient conventional means of releaseably connecting bridge plug 100 to said raising and lowering means, such as cable and cable head, may be used. However, to achieve the major advantage of the present invention, raising and lowering means and releaseable connection means to bridge plug 100 must be capable of withstanding vertical raising forces, acting so as to effectuate removal of the apparatus from the well casing, without failure or separation, in excess of the force required to break the frangible connection between bridge plug 100 and the debris removal device 8.

The combined apparatus of bridge plug 100 and debris removal device 8, now pendantly disposed from suitable raising and lower means, is introduced into well casing 200 as depicted in FIG. 4. The combined apparatus is then lowered through casing 200 toward the bottom of the well by gravitational or forced travel. During the lowering operation, edge 23 initially encounters debris situated within the well bore defined by casing 200, loosening such debris and, in conjunction with vertical surface 21, gauging the well bore to allow unobstructed passage of body 10 and bridge plug 100 through the casing. Debris is funnelled past inner surface 22 and into the interior cavity 13 through second open end 12 of body 10 as a result of the downward travel of the interconnected apparatus. Openings 24 in body 10 allow passage of fluid from interior cavity 13 to the well casing while resisting passage of debris therethrough, thus confining debris to the interior cavity 13 and carrying it toward the bottom of the well bore.

Should the desired depth down the well casing for permanent placement of the bridge plug be reached without encountering an obstruction above such depth which arrests and prevents further downward travel of the combined apparatus, downward travel is stopped by the operator. The bridge plug 100 is then secured at the desired depth by known conventional means, and the raising and lowering means is released and withdrawn. Debris removal device 8 remains interconnected to bridge plug 100 and is abandoned in the casing.

If, however, an obstruction is encountered above the desired depth for bridge plug placement, the value and utility of the present invention will become readily apparent. A tool or device being run down a well casing in completion operations will occasionallly encounter such an obstruction and become lodged or trapped in the casing, such that neither further downward travel nor removal of the tool or device from the casing is possible. It is this risk of trapping which has heretofore mandated a separation of debris removal and bridge plug placement operations, despite the inefficiency and cost associated with the performance of two distinct operations. The standard practice employed to remove the trapped tool or device, such as a conventional junk basket, consists of introducing a drill bit into the casing and drilling through both the trapped device and the obstruction. Conventional junk baskets are typically constructed of a readily destructible or drillable metal and are relatively inexpensive, to facilitate such drilling and minimize economic loss. Bridge plugs in use in the industry, however, are typically constructed of durable material which is not readily destructible and such bridge plugs are costly relative to the expendible junk basket devices.

Assuming, for purposes of illustration and description, that the interconnected bridge plug 100 and debris removal device 8 have become lodged or trapped in the well casing, it will be readily understood that, as a result of debris removal device 8 being the leading portion of the combined apparatus in downward travel and thus the first to contact an obstruction, debris removal device 8 will be affected by the trapping or lodging, leaving bridge plug 100 free but for its interconnection to debris removal device 8.

Such lodging or trapping having occured, the operator causes upward force to be applied to the combined apparatus through the raising and lowering means. Such upward force is communicated to bridge plug 100 through releaseable connecting means and is further communicated to the frangible interconnecting means between bridge plug 100 and debris removal device 8, preferably shear pins 26. It will be recalled that the raising and lowering means and the releaseable connecting means will withstand greater forces before failure or separation than will the frangible interconnecting means between debris removal device 8 and bridge plug 100. Thus, in the preferred embodiment depicted, as the operator increases the upward force applied through the raising and lowering means, shear pins 26 will fail or sever prior to failure of the raising and lowering means or of the releaseable interconnecting means, resulting in complete release of bridge plug 100 from debris removal device 8. Bridge plug 100 may then be readily removed from casing 200 and retained in an undamaged and reuseable condition.

The operator may then introduce a drill bit into the well casing, relieve the existing obstruction by drilling through debris removal device 8 and the obstruction, and subsequently remove the drill bit from the casing. The undamaged bridge plug is the interconnected to a replacement debris removal device and to raising and lowering means, the combined apparatus is reintroduced into well casing 200, and the combined operations of debris removal and bridge plug placement are completed, all as previously described herein.

The debris removal device 8 may be constructed of a destructible or drillable material such as, without limitation, aluminum or magnesium, or alloys thereof. Debris removal and gauge ring device 8 is typically of an overall length approximating eight inches, and proportional relationships between components thereof are generally as indicated by the accompanying Figures. It will be readily understood that such dimensions and proportional relationships may be adapted to accomodate various bridge plug dimensions and well casing diameter without departing from the scope and spirit of the invention herein described and disclosed.

The device and method of the present invention are of considerable value and utility in the completion of gas, oil or water well in that their application achieves a considerable advance in efficiency and reduction of cost beyond the previously known art of debris removal from and bridge plug placement in a well casing. In the drawings and specifications, there has been set forth a preferred embodiment of the invention, and although specific terms are employed, their use is in a generic and descriptive sense only, and not for purpose of limitation.

What is claimed is:

1. A method of removing debris from a well casing and coincidentally placing a bridge plug in such well casing, comprising:

interconnecting the lwoer end of a bridge plug to the upper end of a debris removal device with frangible interconnecting means;

releasably interconnecting the top of said bridge plug to raising and lowering means in a manner capable of withstanding greater separation forces than will said frangible interconnecting means;

inserting said fragibly interconnected bridge plug and debris removal device into said well casing;

causing said frangibly interconnecting bridge plug and debris removal device to travel downwardly through said casing to push ahead and entrap debris within said debris removal device;

encountering an obstruction in said well casing wherein said debris removal device becomes immovable trapped thereby before the desired depth for bridge plug placement is reached;

applying upward force to said bridge plug through said rasising and lowering means releasably interconnected thereto;

increasing the magnitude of such upward force until failure of the frangible interconnection between said bridge plug and said debris removal device occurs;

removing said bridge plug from the well casing in a substantially undamaged and reuseable condition;

removing said obstruction from said well casing by inserting a drill bit, drilling through said debris removal device and said obstruction, and removing the drill bit from said well casing;

frangibly interconnecting a replacement debris removal device to said bridge plug, inserting both into said well casing and causing downward travel thereof until the desired depth in sail well casing for placement for said bridge plug is reached; and setting said bridge in said well casing, releasing said raising and lowering means therefrom and withdrawing said raising and lowering means.

2. The method of claim 1 wherein said debris removal device is constructed of a destructible material.

3. The method of claim 1 wherein the means of frangibly interconnecting said bridge plug and said debris removal device comprises:

a plurality of apertures disposed about the bottom of said bridge plug a plurality of apertures disposed about the top of said debris removal device in coaxial alignment with the apertures in said bridge plug; and a plurality of shear studs extending through said coaxially aligned apertures.

* * * * *